United States Patent [19]

Meyerhofer

[11] Patent Number: 4,791,982

[45] Date of Patent: Dec. 20, 1988

[54] RADIATOR ASSEMBLY

[75] Inventor: Leopold Meyerhofer, Eching, Fed. Rep. of Germany

[73] Assignee: MAN Nutzfahrzeuge GmbH, Fed. Rep. of Germany

[21] Appl. No.: 35,592

[22] Filed: Apr. 6, 1987

[30] Foreign Application Priority Data

May 14, 1986 [DE] Fed. Rep. of Germany ..... 3616307

[51] Int. Cl.[4] ..... F28D 1/00

[52] U.S. Cl. ..... 165/38; 165/148; 165/174

[58] Field of Search ..... 165/148, 174, 146, 38

[56] References Cited

U.S. PATENT DOCUMENTS

| | | | |
|---|---|---|---|
| 1,791,468 | 2/1931 | Leonard | 165/146 |
| 1,893,270 | 1/1933 | Caldwell | 165/146 |
| 1,902,970 | 3/1933 | Ramsaur et al. | 165/148 X |
| 1,919,577 | 7/1933 | Smith | 165/148 X |
| 2,055,549 | 9/1936 | Modine | 165/146 |
| 2,065,708 | 12/1936 | Keirle | 165/146 |
| 2,070,223 | 2/1937 | Butler | 165/146 X |
| 4,397,740 | 8/1983 | Koontz | 165/146 X |
| 4,559,994 | 12/1985 | Waldmann et al. | 165/41 |
| 4,593,749 | 6/1986 | Schatz | 165/41 X |

FOREIGN PATENT DOCUMENTS

| | | | |
|---|---|---|---|
| 3205309 | 8/1983 | Fed. Rep. of Germany . | |
| 3217836 | 11/1983 | Fed. Rep. of Germany . | |
| 3432864 | 3/1986 | Fed. Rep. of Germany | 165/148 |

*Primary Examiner*—Albert W. Davis, Jr.
*Assistant Examiner*—Richard R. Cole
*Attorney, Agent, or Firm*—Scully, Scott, Murphy & Presser

[57] ABSTRACT

A radiator designed more especially for use with IC engines comprises a bank of coolant tubes extending between two coolant heaters. The bank of tubes contains not only smaller tubes with the same bore cross section but furthermore tubes with a larger bore cross section designed to reduce the resistance to flow between the two headers. The presence of such larger tubes in the radiator taking the place of tubes with a smaller cross section and having an equal cross section like the other tubes present in the bank of tubes, makes it possible to avoid using a coolant pump with a larger pumping rate and to avoid the design of the radiator to withstand a higher pressure. It is possible to accept a slight decrease in the radiator performance, such decrease being balanced by other means and in any case being offset by the cost advantages.

8 Claims, 2 Drawing Sheets

RADIATOR ASSEMBLY

BACKGROUND OF THE INVENTION.

The invention relates to radiators and more especially to radiators for cooling IC engines, comprising two coolant headers with assemblies of coolant tubes extending between them.

There is a general trend to provide for the desired cooling effect with a radiator of minimum bulk and with small overall dimensions in order to reduce costs. It is more especially these reasons that have led to the abandonment of radiator designs whose headers are joined by tubes of the same cross section arranged in three planes in favor of designs in which these tubes are arranged in two parallel rows with essentially the same air entry area. At the same time the flow cross section of the tubes has decreased and the number of tubes in each of the two rows has been increased with the result that, although there is a high air speed through the radiator and an improved heat transfer to the heat conducting fins, this was at the cost of a greatly increased resistance to flow; furthermore the modifications were not, on balance, able to compensate for the absence of the third tube row because of the following reasons: the decrease in the cross section of the tubes involved an increase in the performance of the coolant pump if the coolant flow rate was to be maintained, and this led to an increase in pressure, more especially at the coolant inlet port of the radiator. The result of both these factors was an increase in price, that is to say on the one hand, of the radiator means itself owing to the heavy duty coolant pump needed and the design of the radiator to withstand greater heads, while on the other hand the operation of the engine became more expensive owing to the lower mileage. This increase in engine running costs was due to the greater power that had to be produced by the engine leading to a high fuel consumption.

A similar disadvantage was to be found in the case of the radiator in accordance with the German specification No. 3,217,836, in which means were provided for controlling the number of tubes of a coolant tube bank through which coolant is able to flow. Since in this case either all the tubes or only a fraction of them were able to carry coolant flowing in one direction, it is necessary for the coolant pump to be designed with a pumping rate to suit the smallest overall tube cross section which is still open, that is to say it had to be made with a performance greatly in excess of normal performance. Much the same applies for the design of the radiator, since it had to be made to suit the minimum free overall tube cross section and the pressures then obtaining in the radiator.

SHORT SUMMARY OF THE PRESENT INVENTION.

Taking this prior art into account, one object of the present invention is to provide a radiator with a lower overall depth while at the same time keeping to essentially the same air inlet area.

A further aim of the invention is to provide such a radiator with tubes arranged, for instance, in two planes as opposed to three planes in the prior art.

A still further object of the invention is to devise such a radiator with the use of the simplest possible means, that is to say in such a way that the pressure rating does not have to be higher than in radiators as used in the prior art.

Another of the aims of the invention is to provide a radiator which may be used with a coolant pump with a pumping rate which is the same or even lower than in the prior art.

In order to achieve these or other objects, in the invention the raidator not only has a plurality of tubes with the same bore cross section but also a number of tubes with a larger bore cross section for reducing the resistance to flow in the tube bank.

Preferred developments and possible outgrowths of the invention are indicated in the claims.

The radiator in accordance with the invention makes it possible to dispense with a coolant pump having a higher pumping rate; moreover the pressure rating of the radiator does not have to be enhanced. Owing to the provision of the tubes with a larger bore cross section, there is admittedly a certain reduction in the performance of the radiator on account of the reduction of the flow velocity in the tubes with a smaller cross section and due to the reduction in the effective cooling area by an amount equal to the space required for the tubes with a large bore cross section. However the said reduction in the cooling performance is not excessive and may be balanced by other measures. The possible disadvantages are far outweighed by the useful features, that is to say that the radiator is generally more readily and more cheaply manufactured and that the said design features of the invention do not have an undesired effect on the operation of the IC engine.

In what follows one working emobodiment of the invention will be described with reference to the drawings.

LIST OF THE SEVERAL VIEWS OF THE DRAWINGS.

Figure 1:
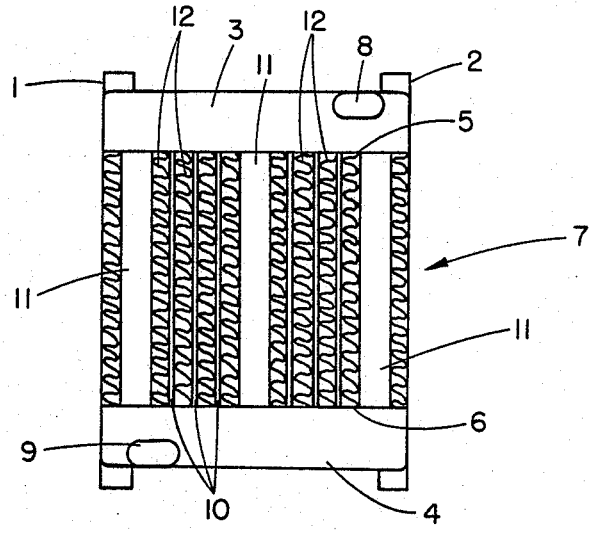
FIG. 1 is a highly diagrammatic front view of a radiator in accordance with the invention.
Figure 2:
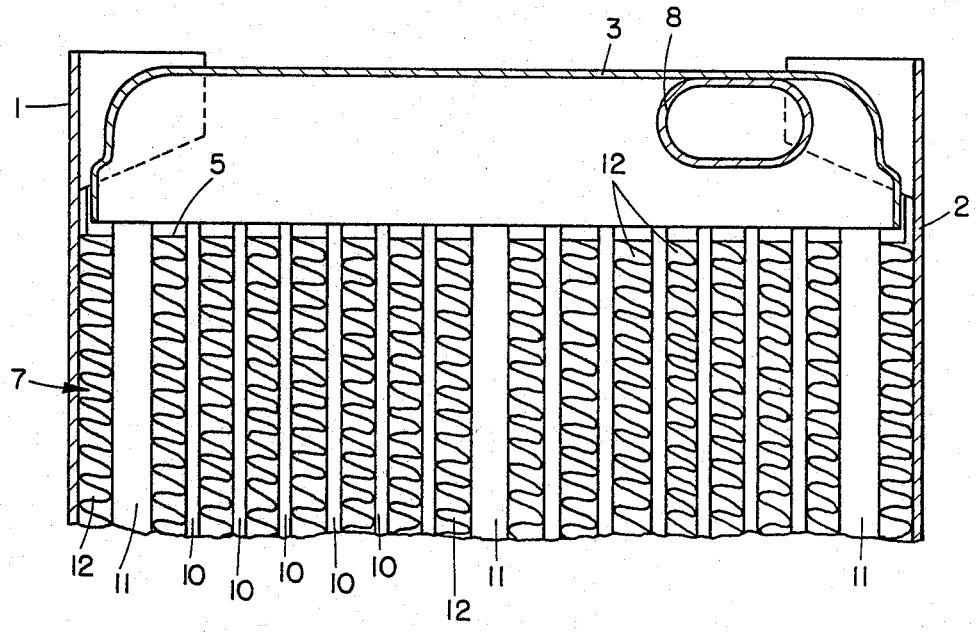
FIG. 2 is a longitudinal section through the top part of the radiator.

DETAILED ACCOUNT OF THE WORKING EMBODIMENT OF THE INVENTION.

The radiator shown in the drawings is part of the coolant circuit of an IC engine which may either be incorporated in a vehicle driven by the IC engine or made part of a stationary power plant operated thereby. Reference numeral 1 denotes the left hand frame part and 2 a right hand frame part. Reference numeral 3 denotes the upper coolant, in this case water, header and numeral 4 denotes the lower header of the radiator. The upper coolant head 3 has as its lower wall a tube plate 5 while the lower coolant head 4 has an upper tube plate 6 facing the heat exchange part 7 of the radiator. Each coolant header 3 and 4 has a tube connector 8 and 9, respectively, for the supply and return of the coolant to and from the radiator.

Figure 3:
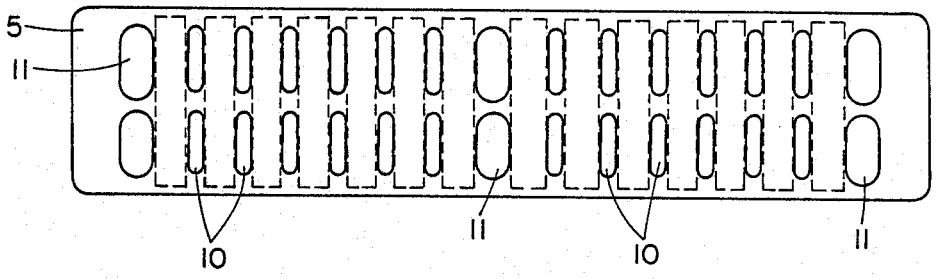
FIG. 3 is a plan view of the radiator after removal of one header.
Figure 4:
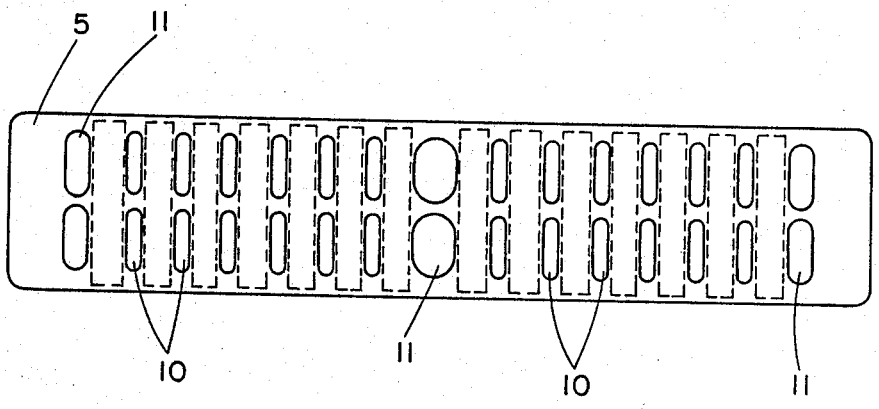
FIG. 4 is a plan view of the radiator after removal of one header showing larger tubes having different bore cross-sections.

Between the two coolant headers 3 and 4 of the radiator there is a bank of tubes for coolant to flow through, whose upper and lower ends are sealingly connected with the tube plates of the headers. In the bank of tubes there is furthermore a number of tubes with a larger bore which serve to reduce the resistance to flow between the headers. The tubes 10 and 11 are, as indicated in FIG. 3, arranged in two parallel rows. Between each two adjacent tubes there are fins 12 of corrugated sheet metal in contact with the air flow.

The tubes 11 serving to reduce the resistance to flow between the two headers and of which there are about 2 to 20 arranged evenly amongst the other tubes in the bank, have a bore cross section that is 2 to 20 larger than that of the smaller tubes. Preferably the bore cross section of all the larger tubes 11 in the bank is the same, but this is not necessarily so and the larger tubes 11 may have different diameters. The sum bore cross section area of all the larger tubes 11 is equal 0.1 to 0.3 times the sum cross bore cross section area of the smaller tubes 10.

A radiator in keeping with the invention may have smaller tubes arranged in two parallel rows in which the tubes 10 and 11 are placed with the same clearance distance between them. In each row there may be at least one larger tube 11. The larger tubes are preferably symmetrical in relation to the smaller tubes 10 so that there is a more or less evenly distributed flow velocity in the two headers.

The provision of larger tubes 11 in the invention taking the place of tubes 10 with a smaller cross section means that the radiator may be designed for a higher cooling performance without having to have a more powerful pump and a higher pressure rating of the radiator.

What is claimed is:

1. A radiator comprising two headers and a bank of tubes joining the two headers together to enable coolant to flow between the headers and to be cooled in the tubes, said two headers including an upper header having a lower tube plate facing said bank of tubes and a lower header having an upper tube plate facing said bank of tubes, said tubes comprising small tubes with the same bore cross section and a number of larger tubes with a larger bore cross section for lowering the resistance of coolant flow between the headers, each of said small and larger tubes extending between said lower and upper tube plates and having inlets on the opposite ends of the tubes being in the same plane of the respective tube plate, whereby coolant normally flows through both the small and larger tubes, said small and larger tubes are arranged in at least two parallel rows, there being at least one of said larger tubes in each said row of tubes and the sum bore cross section of all of said larger tubes is equal to 0.1 to 0.3 times the sum bore cross section of the smaller tubes.

2. The radiator as claimed in claim 1 wherein said tubes with a larger bore cross section have a bore cross section which is between 2 and 10 times that of the small tubes.

3. The radiator as claimed in claim 1 wherein all the larger tubes have the same bore cross section.

4. The radiator as claimed in claim 1 wherein the larger tubes have different bore cross sections.

5. The radiator as claimed in claim 1 wherein the number of the larger tubes is equal to between 2 and 20.

6. The radiator as claimed in claim 1 wherein the larger tubes are regularly distributed in the bank of smaller tubes.

7. The radiator as claimed in claim 6 wherein the number of the larger tubes is equal to between 2 and 20 and the tubes are arranged in two parallel rows with the same clearance distance between the tubes.

8. The radiator as claimed in claim 1 in the form of a motor vehicle radiator.

* * * * *